US006312520B1

(12) United States Patent
Eriksson et al.

(10) Patent No.: US 6,312,520 B1
(45) Date of Patent: Nov. 6, 2001

(54) COATING BLADE HAVING A WEAR-RESISTANT EDGE

(75) Inventors: Tore Eriksson, Klässbol; Håkan Karlsson, Säffle, both of (SE)

(73) Assignee: BTG Källe Inventing AB, Säffle (SE)

( * ) Notice: Subject to any disclaimer, the term of this patent is extended or adjusted under 35 U.S.C. 154(b) by 0 days.

(21) Appl. No.: 09/319,865

(22) PCT Filed: Dec. 16, 1997

(86) PCT No.: PCT/SE97/02110

§ 371 Date: Jun. 14, 1999

§ 102(e) Date: Jun. 14, 1999

(87) PCT Pub. No.: WO98/26877

PCT Pub. Date: Jun. 25, 1998

(30) Foreign Application Priority Data

Dec. 19, 1996 (SE) ..... 9604697

(51) Int. Cl.[7] ..... B05C 11/04

(52) U.S. Cl. ..... 118/106; 118/119; 118/126; 162/281

(58) Field of Search ..... 118/106, 118, 118/119, 123, 126, 257, 261, 413; 427/356; 162/281; 15/256.5

(56) References Cited

U.S. PATENT DOCUMENTS

| | | | | |
|---|---|---|---|---|
| 3,575,134 | * | 4/1971 | Quint | 118/122 |
| 5,119,755 | * | 6/1992 | Beisswanger | 118/123 |
| 5,536,312 | * | 7/1996 | Madrzak et al. | 118/118 |
| 6,059,881 | * | 5/2000 | Nomura et al. | 118/126 |

FOREIGN PATENT DOCUMENTS

| | | |
|---|---|---|
| 0505020A1 | 9/1992 | (EP) . |
| 1206106 | 9/1970 | (GB) . |
| 468344 | 12/1992 | (SE) . |
| WO88/10155 | 12/1988 | (WO) . |

* cited by examiner

*Primary Examiner*—Laura Edwards
(74) *Attorney, Agent, or Firm*—Burns, Doane, Swecker & Mathis, L.L.P.

(57) ABSTRACT

Coating blade for applying coating material onto a travelling web (41), particularly coating liquid onto a travelling paper web, comprising a steel band (3), which, along the edge section (7) intended to engage the web (41), is provided with a wear-resistant coating (5). Said coating is constituted by a material which has a hardness according to Shore A of from about 30 to about 80.

20 Claims, 3 Drawing Sheets

COATING BLADE HAVING A WEAR-RESISTANT EDGE

The present invention relates to a coating blade for applying coating material onto a travelling web, particularly coating liquid or paste onto a travelling paper web.

The traditional blade coating technology is based on the fact that the blade can deflect, i.e. that the blade in its cross-direction will be subject to deflection when the blade by one longitudinal edge thereof engages a travelling web. Contrary hereto Swedish patent 468 344 discloses a technology where the blade rather than being deflected has a movable attachment enabling movement of the blade towards and away from the travelling web. By using this technology it is possible to use coating blades which essentially have no bending capacity.

Since the primary function of the coating blade is to even and remove excess of a coating liquid containing hard particles, for example titanium dioxide, calcium carbonate and the like, the edge section of the blade engaging the travelling web will be subject to continuous wear. Such wear can be caused also by particles found in the paper web proper. As soon as the blade has reached a certain degree of wear it has to be replaced. Such replacement of blade involves high costs, on the one hand caused by the cost of the blade per se, on the other hand also and essentially by the production interruption caused by the change of blade.

An important property of coating blades is thus that the resistance to wear or abration is as high as possible. Since the blades which are used in the traditional blade coating techniques also shall have springing properties which to some extent result in a lower resistance to wear the blade quality becomes a compromise between spring properties and wear resistance.

In addition to the fact that the wear resistance of the blades is dependent on the material of the blade it is also known to coat the engagement surface of the blade with wear-resistant materials, for example ceramic materials or chromium. In view of the fact that such wear resistant layers shall be applied to elongate and thin materials, often steel bands, limitations in production will arise resulting in high production costs.

The present invention has for its main object to provide a coating blade of improved resistance to wear. Another object of the invention is to provide coating blades which can be manufactured at a low cost.

Yet another object of the invention is to provide blades which give advantages in a quality with regard to the coated layer. For these and other objects which will be clear from the following disclosure there is provided by the present invention coating blades for applying a coating material onto a travelling web. Although the invention is not restricted hereto it Will in the following be described particularly in connection with the application of a coating liquid onto a travelling paper web. The coating blade according to the invention includes a band of steel or other form-stable material which, along the edge section intended to engage the web, is provided with a wear-resistant coating. In accordance with the present invention it has been surprisingly found that if said coating is constituted by a material of a relatively low hardness, namely a hardness of about 10 to about 100 measured in accordance with Shore A, substantial advantages are gained in connection with the use of the coating blade.

The fact that the use of a coating blade having a coating of a relatively soft material resulted in a high wear resistance in combination with important operational advantages was completely surprising to the skilled artisan. As acknowledged in the conventional art one has looked for coating with hard materials, for example cerams, metals or the like, for the purpose of obtaining a high wear resistance, and the relatively complicated techniques that have to be used for the application of this type of hard coatings has involved high production costs and thereby an undesired high price on the final product.

In connection with the present invention it is preferred that the coating applied to the coating blade has a hardness according to Shore A of about 30 to about 80, particularly about 40 to about 70. It is particularly preferred that the hardness according to Shore A lies within the range of about 50 to 60.

The surprising observation on which the present invention is founded, namely the possibility of using a relatively soft material as a coating, means that said coating material can be constituted by an organic polymer. Examples of useful polymers are polyurethanes, styrene-butadiene polymers, i.e. polymers of rubber type, and polyolephins.

A particularly preferred type of polymer is polyurethanes, the building stones of which in a conventional manner are constituted by polyoles and diisocyanates. Usual diisocyanates for polyurethane systems are toluene diisocianate, diphenylmethane diisocyanate and naphtalene diisoocyanate. Also less common diisocyanates are available, such as hexamehtylene diisocyanate and isoforon diisocyanate. Polyurethanes are available for example as esterurethanes, etherurethanes and urethanes based on hydroxyl-terminated polybutandienes.

What type of pure polyurethane that is used in the present invention is not critical for the practical result as long as the hardness thereof lies Within the ranges given above.

Experiments carried out while using the techniques according to the present invention have shown that the material results in high wear-resistance or abrasion-resistance but also other advantages, such as improved fiber coverage and operability, i.e. low failure frequency, have been recorded. The soft coating gives an improved complience vis-à-vis the paper surface and thereby results in a lower puttying effect compared to traditional hard blades or blade coatings. The improved operability is probably due to the fact that the soft coating at the edge of the blade more easily allows passage of the particles which are present in the paper web or in the coating paste in view of the fact that the soft material will be elasticly deformed by the particle. Immediately after the passage of a particle the coating material then regains its starting position.

In view of the elasticity of the coating at the edge of the blade in engagement with the travelling web the blade edge also to some extent adapts to the contour of the paper surface which results in the desired effect that the coating layer covers the fibers of the base paper in a more even manner than in traditional coating using hard blades or blade coatings. This effect has been shown by extensive pilot experiments, where the result with regard to failure frequency and fiber coverage has been studied. In comparison with regard to rupture frequency the number of ruptures of the web occurring at the blade have been counted. The runs have been carried out at equal conditions with regard to base paper quality, running time, coating machine variables etc.

In the comparison with regard to fiber coverage the results have been studied by so called "burning tests" and colouring with an absorbing type of colour "kroda". The burning test is carried out by moisturing the coated paper surface with an about 10% ammonium chloride solution. This chemical results in darkening of the cellulose fibers when the paper is heated to about 300–400° C. using a heat pistol or in a furnace. The white coating layer then appears in contrast against the dark substrate.

This test shows quite clearly how the coating layer has been distributed on the surface of the paper. The result of this comparison shows clearly that a polymer-coated blade in accordance with the invention results in a coating layer of a more even thickness as compared to a steel blade of conventional type which results in a flamy effect and thus greater amount of coating in the "valleys" of the paper surface and less coating on the "tops" of the paper surface.

The colouring test also shows the same result in that the colour is absorbed more on the sections where the coating layer is thinner. In view of the fact that the "valleys" of the paper surface are filled with the polymer coated blade as compared to the steel blade the surface irregularity will remain to some extent, whereas the positive effects of a reduced rupture frequency and improved fiber coverage is of a greater importance for many papers qualities.

The steel band used in the coating blade according to the present invention suitably has a thickness lying within the range about 0.2 to about 2 mm. The coating applied has a thickness which suitably lies within the range about 0.5 to about 5 mm.

In a particular embodiment of the coating blade according to the invention the coating covers said edge section and is provided with a chamfer for he enlargement of the surface of engagement of the coating on the travelling web.

The width of the coating as seen in a plane of the blade and perpendicular to its longitudinal direction is suitably about 5 to 25 mm, but this dimension is not particularly critical.

The invention also provides for an apparatus for the coating of a travelling web comprising means to carry and transport the web and two opposite coating blades extending across the web and engaging same with one edge section thereof, and which at the opposite edge are arranged in a blade holder for each blade with a fastening which allows movability to and fro the web of said edge section without essential deflection of the blade. In this apparatus according to the invention pressure means are arranged which at said edge section can bring each blade to engage the web forwarded between the opposite coating blades. The characterizing feature of the apparatus is that both coating blades are provided with a coating in accordance with the above description.

The apparatus according to the invention is particularly useful for the coating of thin paper qualities which are difficult to produce with low rupture frequencies. In the particular coating techniques where the web is fed between two opposite coating blades the use of blades having soft coatings is particularly advantageous. In the apparatus according to the present invention for two-sided coating of a travelling web by the use of juxtaposed coating blades pilot experiments have shown a substantially reduced rupture frequency. The method of using juxtaposed coating blades has previously found limited use in view of the fact that it easily results in web failure when using traditional hard blades or blade coatings. The web failures arise in view of the fact that lumps or particles in the paste and/or in the web often cannot pass the nip between the blades without being arrested thereby rupturing the web.

As examples in comparing tests between traditional steel blades and a steel blade which along the engaging edge section has been coated with a polymer consisting of a polyurethane based on diphenylmethane diisocyanate (MDI) with a hardness of about 60° Shore A and with otherwise similar conditions have shown that traditional blades run for 2 hours resulted in 11 ruptures, whereas the blade coated with polyurethane did not result in any rupture at all.

The techniques based on the use of soft coatings on hard carrier materials is, in accordance with the present invention, not restricted to the use of only polyurethane of the types exemplified above but can also be constituted by other materials having the hardness properties which satisfy the requirements for operability with concommitant low rupture frequency and quality related to a certain production. The characterizing feature of the coating blade in accordance with the present invention is the fact that the coating is attached by vulcanization, gluing or casting on a carrier material in the form of a band of steel or other dimension-stable material meeting with the required shape and position tolerances, such as straightness, width, length and thickness. The techniques according to the present invention based on the use of soft coating materials further result in the advantage that the steel band can be bent and wound without the coating being damaged or disattached.

The present invention will in the following be exemplified by non-limiting examples in connection with the appended drawings, wherein.

Figure 1:
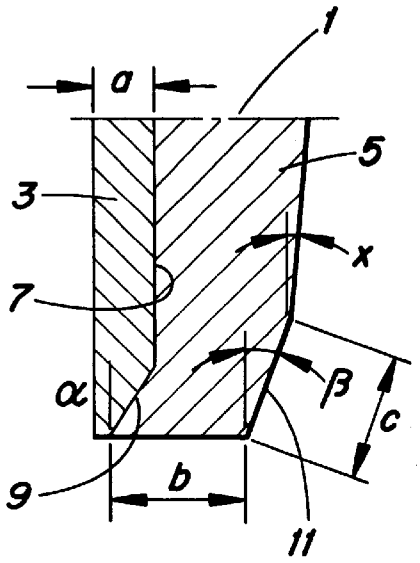
FIGS. 1–3 show diagrammatically cross-sections through coating blades according to the present invention designed with varying cross-sections.

FIG. 1 shows the edge section of a coating blade generally designated 1 comprising a steel band 3, a coating 5 across the edge section 7 of the steel band 3. The steel band 3 is at its outer edge provided with a chamfer 9, and the coating 5 has a corresponding chamfer 11, whereby the surface of engagement against the travelling web will be enlarged.

Figure 2:
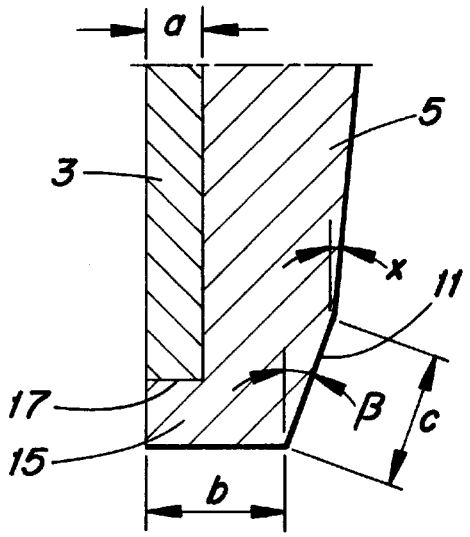

FIG. 2 shows another embodiment of the coating 5, in this case provided with a part 15 covering the outer edge 17 of the steel band 3. Also in this case the coating 5 has a chamfer 11.

Figure 3:
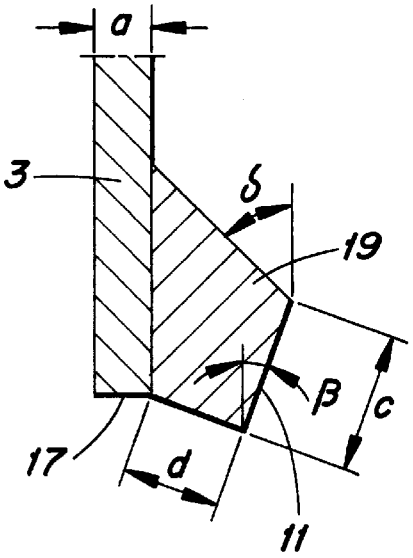

Finally, FIG. 3 shows a third embodiment of the coating blade according to the invention, where the free edge 17 of the steel band 3 is straight and uncoated. In this embodiment the coating 19 is designed with a tetrahedral cross-section, again with a chamfer 11 defining the surface of engagement against the travelling web.

In the embodiments shown in FIGS. 1–3 certain dimensions and angles have been alotted designations. In the table below values and intervals with regard to these dimensions and angles are given. With regard to dimensions a, b, c and d the measurements are in millimeters.

TABLE

| | a | b | c | d | α | β | χ | δ |
|---|---|---|---|---|---|---|---|---|
| FIG. 1 Exemplified | 0.8 | 2.0 | 2.0 | — | 30° | 20° | 5° | — |
| FIG. 1–2 Preferred range | 0.6–1 | 1–2.5 | 1–2.5 | — | 15°–45° | 15°–35° | 0–10° | — |
| FIG. 1–2 range | 0.25–2 | 0.5–5 | 0.5–5 | — | 0–60° | 5°–50° | 0–15° | — |
| FIG. 3 range | 0.25–2 | — | 0.5—5 | 0.5—5 | 0–60° | 5–50° | — | 0–75° |

Figure 4:
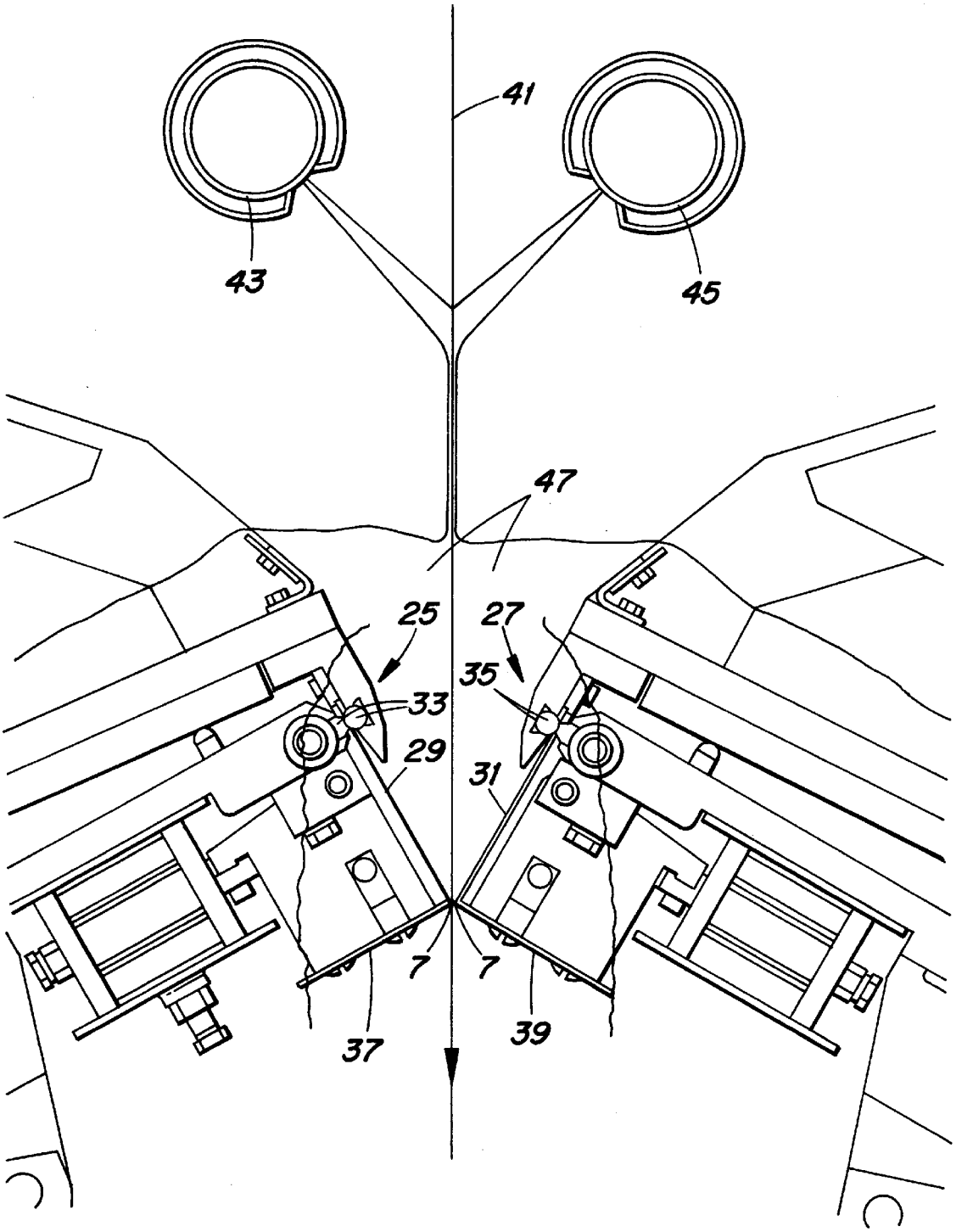
FIG. 4 shows diagrammatically an apparatus according to the invention with two juxtaposed coating devices.

FIG. 4 shows an apparatus according to the present invention, comprising two juxtaposed blade coating devices generally designated 25,27. Each blade coating device includes a coating blade 29,31 and a blade holder 33,35 operating with movable attachment of the respective blade so that they can move against and away from the travelling web. The blades 29,31 are brought to engagement against the travelling web 41 by means of pressure ledges 37,39 actuating the blades near their free edges thereof.

The blade coating devices 25,27 which are shown only diagramatically in FIG. 4 can be designed in accordance with the device described in patent application WO93/05887, and with regard to constructional details reference is made to the disclosure of said patent application.

As is further clear from FIG. 4 a paper web 41 is fed in a downward direction in the nip between the two coating blades 29,31. Before the nip the paper web 41 is applied on both sides thereof with a coating paste by means of diagrammatically shown applicators 43,45 which before the nip between the coating blades 29,31 form ponds 47 of coating paste.

Figure 5:
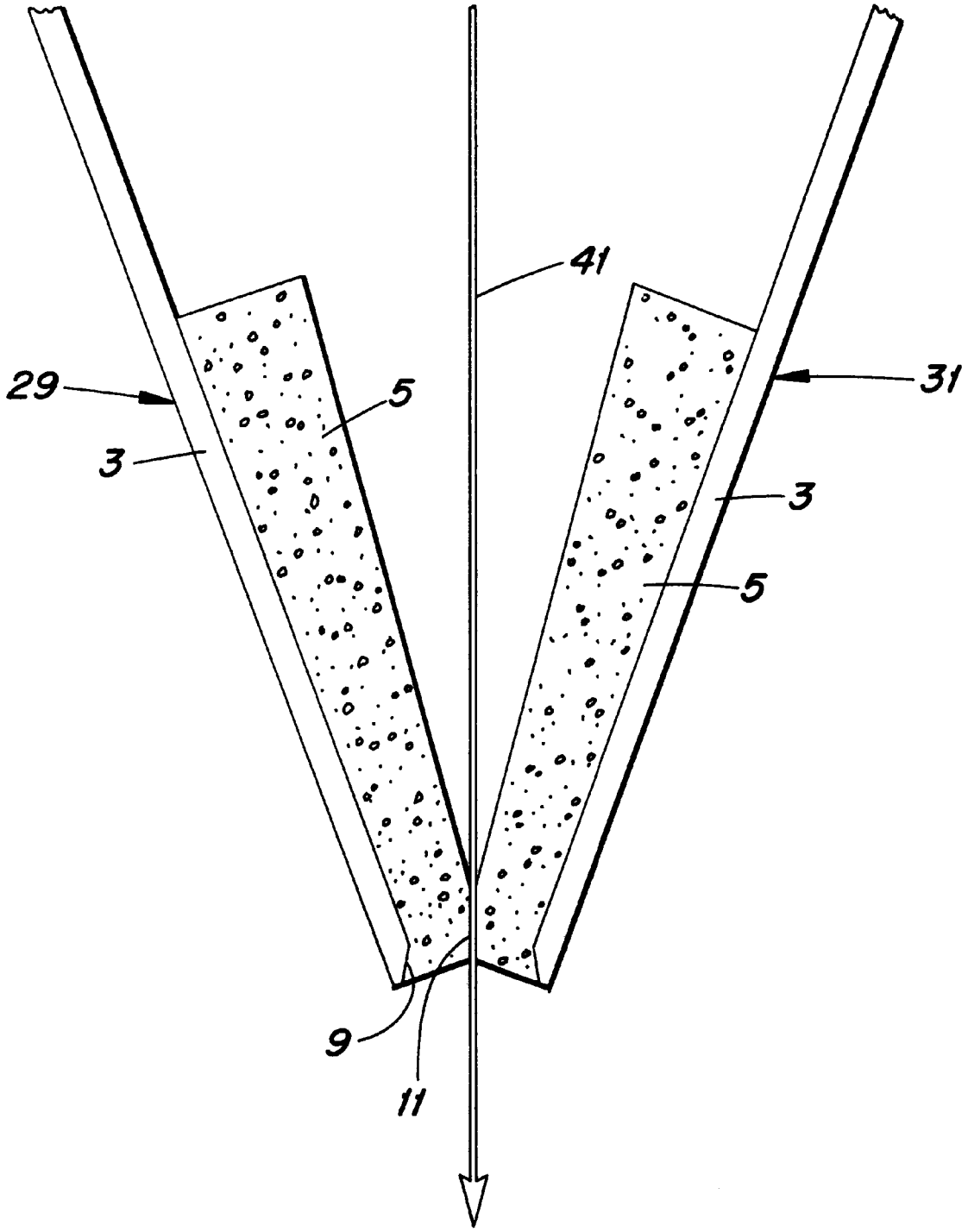
FIG. 5 shows a detail of the area around the two juxtaposed coating blades with associated coatings.

FIG. 5 shows a detail of the area around the free edges of the juxtaposed coating blades 29,31 with coatings 5 with chamfered engagement surfaces 11.

As previously indicated the invention is not restricted to the embodiments shown since changes and modifications are obvious to the skilled artisan. Thus, the invention is not restricted in other way than as is clear from the appended patent claims.

What is claimed is:

1. Coating blade for applying coating material onto a travelling web, comprising a steel band having an edge section intended to engage the web, the edge section having a wear-resistant coating, the coating comprising a material having a hardness according to Shore A of about 30 to about 80.

2. Coating blade according to claim 1, wherein the material has a hardness of about 40 to about 70.

3. Coating blade according to claim 2, wherein the material comprises an organic polymer.

4. Coating blade according to claim 2, wherein the steel band has a thickness within the range about 0.2 to about 2 mm.

5. Coating blade according to claim 2, wherein the coating has a thickness within the range about 0.5 to about 5 mm.

6. Coating blade according to claim 2, wherein the coating covers the edge section and is provided with a level for enlargement of a surface of engagement against the web.

7. Coating blade according to claim 2, wherein the coating, when viewed in a plane of the blade and perpendicular to a longitudinal direction of the blade, has a width of about 5 to about 25 mm.

8. Coating blade according to claim 1, wherein the material comprises an organic polymer.

9. Coating blade according to claim 8, wherein the organic polymer is selected from polyurethanes, styrene-butadiene polymers and polyolephins.

10. Coating blade according to claim 9, wherein the organic polymer is a polyurethane.

11. Coating blade according to claim 8, wherein the steel band has a thickness within the range about 0.2 to about 2 mm.

12. Coating blade according to claim 8, wherein the coating has a thickness within the range about 0.5 to about 5 mm.

13. Coating blade according to claim 8, wherein the coating covers the edge section and is provided with a level for enlargement of a surface of engagement against the web.

14. Coating blade according to claim 1, wherein the steel band has a thickness within the range about 0.2 to about 2 mm.

15. Coating blade according to claim 1, wherein the coating has a thickness within the range about 0.5 to about 5 mm.

16. Coating blade according to claim 1, wherein the coating covers the edge section and is provided with a level for enlargement of a surface of engagement against the web.

17. Coating blade according to claim 1, wherein the coating, when viewed in a plane of the blade and perpendicular to a longitudinal direction of the blade, has a width of about 5 to about 25 mm.

18. Apparatus for coating a travelling web, comprising:

means to carry and transport the web;

two opposite coating blades extending across the web, the two coating blades each having one edge section for engaging the web and one opposite edge;

each of the two coating blades being arranged with its opposite edge in a different blade holder for each of the two coating blades, each blade holder having a fastening which allows movability of the edge section relative to the web without essential deflection of the blade; and drivers for causing the edge section of each of the two coating blades to engage the web transported between the two coating blades, wherein the edge section of each coating blade of the two coating blades has a wear-resistant coating, the coating comprising a material having a hardness according to Shore A of about 30 to about 80.

19. Apparatus for coating a travelling web, comprising:

means to carry and transport the web;

two opposite coating blades extending across the web, the two coating blades each having one edge section for engaging the web and one opposite edge;

each of the two coating blades being arranged with its opposite edge in a different blade holder for each of the two coating blades, each blade holder having a fastening which allows movability of the edge section relative to the web without essential deflection of the blade; and drivers for causing the edge section of each of the two coating blades to engage the web transported between the two coating blades, wherein the edge section of each coating blade of the two coating blades has a wear-resistant coating, the coating comprising a material having a hardness according to Shore A of about 30 to about 80.

20. Apparatus for coating a travelling web, comprising:

means to carry and transport the web;

two opposite coating blades extending across the web, the two coating blades each having one edge section for engaging the web and one opposite edge;

each of the two coating blades being arranged with its opposite edge in a different blade holder for each of the two coating blades, each blade holder having a fastening which allows movability of the edge section relative to the web without essential deflection of the blade; and drivers for causing the edge section of each of the two coating blades to engage the web transported between the two coating blades, wherein the edge section of each coating blade of the two coating blades has a wear-resistant coating, the coating comprising a material having a hardness according to Shore A of about 30 to about 80, wherein the material comprises an organic polymer.

* * * * *